US008893912B2

(12) United States Patent
Van Der Molen et al.

(10) Patent No.: US 8,893,912 B2
(45) Date of Patent: Nov. 25, 2014

(54) CLOSURE DEVICE

(75) Inventors: Peter Jan Van Der Molen, Dan Haag (NL); Laurens Last, Bosch en Duin (NL); Jeroen Gerrit Anton Gebbink, Bruxelles (DE)

(73) Assignee: IPN IP B.V., Houten (NL)

( * ) Notice: Subject to any disclaimer, the term of this patent is extended or adjusted under 35 U.S.C. 154(b) by 0 days.

(21) Appl. No.: 13/821,544

(22) PCT Filed: Sep. 6, 2011

(86) PCT No.: PCT/NL2011/050610

§ 371 (c)(1),
(2), (4) Date: May 16, 2013

(87) PCT Pub. No.: WO2012/033405

PCT Pub. Date: Mar. 15, 2012

(65) Prior Publication Data

US 2013/0292380 A1 Nov. 7, 2013

(30) Foreign Application Priority Data

Sep. 8, 2010 (NL) ..... 2005329

(51) Int. Cl.

| | |
|---|---|
| ***B65D 51/20*** | (2006.01) |
| ***B65D 17/30*** | (2006.01) |
| ***B65D 17/42*** | (2006.01) |
| ***B65D 51/22*** | (2006.01) |
| ***B65D 47/20*** | (2006.01) |
| ***B65D 75/58*** | (2006.01) |

(52) U.S. Cl.

CPC ..... *B65D 51/22* (2013.01); *B65D 47/2081* (2013.01); *B65D 51/226* (2013.01); *B65D 51/227* (2013.01); *B65D 75/5883* (2013.01); *B65D 2251/0015* (2013.01); *B65D 2251/0056* (2013.01); *B65D 2251/0062* (2013.01)

USPC ..... 220/258.4; 220/267; 220/277; 222/83

(58) Field of Classification Search

USPC ..... 220/258.1, 258.3, 258.4, 265, 267, 277; 222/80, 81, 83

See application file for complete search history.

(56) References Cited

U.S. PATENT DOCUMENTS 5,482,176 A * 1/1996 Maietta et al. ..... 220/277

(Continued)

FOREIGN PATENT DOCUMENTS

EP 0304972 A1 3/1989
EP 2143658 A1 1/2010

(Continued)

OTHER PUBLICATIONS

International Search Report completed Oct. 26, 2011 for priority application PCT/NL2011/050610.

(Continued)

*Primary Examiner* — Steven A. Reynolds
*Assistant Examiner* — Javier A Pagan
(74) *Attorney, Agent, or Firm* — Troutman Sanders LLP; Ryan A. Schneider; Christopher W. Glass

(57) ABSTRACT

A closure device (1) for a product dispensing container. The closure device comprises a base (2) having a body with a connector portion (2*a*) adapted to mount the closure device on a product container. The base comprises a product channel (5) and a rupturable seal (4) occluding the product channel and forming a lower seal of the closure device. A rotary part (20) is rotatably journalled on the base. The rotary part has a product passage (21) in communication with the product channel in the base. An upper sealing arrangement (30) is arranged on the rotary part and forms an upper seal of the closure device that is remote from the lower seal and seals the product passage of the rotary part. A lower seal rupturing member (40) is movable in a rupturing motion relative to the base to rupture the rupturable lower seal. A motion transfer (27, 42, 3*b*, 41) means is provided and is adapted so as to effect the rupturing motion of the lower seal rupturing member upon suitable rotary actuation of the rotary part. A protective overcap (10) is removable by the user.

19 Claims, 18 Drawing Sheets

(56) References Cited

U.S. PATENT DOCUMENTS

| | | | | |
|---|---|---|---|---|
| 7,971,739 | B2 * | 7/2011 | Ammann | 215/257 |
| 2004/0099686 | A1 | 5/2004 | Rho | |
| 2004/0251276 | A1 | 12/2004 | Adams | |
| 2009/0050648 | A1 * | 2/2009 | Wisniewski | 222/83 |
| 2010/0215294 | A1 | 8/2010 | Berman | |
| 2010/0230410 | A1 * | 9/2010 | Last et al. | 220/258.4 |

FOREIGN PATENT DOCUMENTS

| | | | |
|---|---|---|---|
| WO | 01/036289 | A1 | 5/2001 |
| WO | 2006/028378 | A1 | 3/2006 |

OTHER PUBLICATIONS

Search Report and Written Opinion for priority application NL2005329 dated Mar. 16, 2011.

* cited by examiner

CLOSURE DEVICE

BENEFIT CLAIMS

This application is a U.S. National Stage of International Application No. PCT/NL2011/050610, filed 6 Sep. 2011, which claims the benefit of NL 2005329, filed 8 Sep 2010.

FIELD OF INVENTION

The invention relates to a closure device that allows to dispense a product from a product container, for example from a bottle or a collapsible pouch.

BACKGROUND OF THE INVENTION

Closure devices are known comprising a base having a body with a connector portion adapted to mount the closure device on a product container, e.g. by screwing the closure device on the neck of a container or heat- or induction sealing the base to a collapsible pouch.

In known devices the base has a product channel, wherein a rupturable seal is present that spans across the product channel and so occludes the product channel. Examples are shown in WO01/36289. In these examples the closure device includes a protective overcap that is removable by the user upon first opening of the container. Typically an overcap is removable prior to when use of the container is initiated. The overcap is often discarded but may be re-used if desired.

OBJECT OF THE INVENTION

The present invention aims to provide an improved closure device, or at least provide an alternative to existing closure devices.

The present invention aims to provide a closure device having a reliable barrier function as long as the product container has not been opened, e.g. shielding the product against ingress of air. The present inventions aims to provide such a closure device with a simple and intuitive user-handling of the closure device.

SUMMARY OF THE INVENTION

The present invention achieves one or more of the objects above by providing a closure device for dispensing a product from a product container, the closure device comprising a base having a body with a connector portion adapted to mount the closure device on a product container, the base comprising a product channel in the body of base and a rupturable seal occluding the product channel and forming a lower seal of the closure device, the closure device further comprising a rotary part that is rotatably journalled on the base, wherein the rotary part has a product passage in communication with the product channel in the base, an upper sealing arrangement arranged on the rotary part of the forming an upper seal of the closure device that is remote from the lower seal and seals the product passage of the rotary part, a lower seal rupturing member that is movable in a rupturing motion relative to the base to rupture the rupturable lower seal, motion transfer means adapted so as to effect the rupturing motion of the lower seal rupturing member upon suitable rotary actuation of the rotary part, a protective overcap that is removable by the user, wherein the upper sealing arrangement is in closed condition prior to first time removal of the overcap, wherein the overcap is connected to the base and is adapted to be rotated by the user with respect to the base in order to remove the overcap from the base, wherein the overcap engages on the rotary part so as to cause rotary motion of the rotary part upon removal of the overcap, so the lower seal rupturing member effects the rupturing motion to rupture the rupturable lower seal and thereby open the product channel by user removal of the overcap.

The rotary part is rotatable with respect to the base, and the motion transfer means cause the lower seal rupturing member to perform its rupturing operation as the rotary part is rotated. This rotation is effect as the user removes the overcap from the closure device for the first time by a rotational motion, which is a simple, intuitive motion to perform by the user. So during the process of removing the overcap the user —basically without being aware thereof—also causes the rupturing of the lower seal. In a practical embodiment said lower seal, as well as the rupturing member, may be invisible for the user, so that the user is not even aware of the presence of such a lower seal.

The rupturing of the lower seal may involve the cutting, piercing, tearing or similar of the rupturable seal or combinations thereof.

As the upper sealing arrangement remains closed during the removal of the overcap, the risk of spillage is limited or absent.

This closure device has the benefit of the additional barrier effect provided by the lower rupturable seal, e.g. when said lower seal includes one or more metal layers, e.g. as a foil, without burdening the user with an extra activity to rupture the lower seal.

Also the closure device has the benefit of the overcap, which is well known to consumers and provides a hygienic cover over the dispensing portion of the closure device, e.g. against dust or other contamination.

The overcap may, in a possible embodiment, provide a full hermetic sealing with respect to the base, so that there is no communication between the space inside the overcap and the environment prior to removal of the cap. This is e.g. desirable for aseptic closures.

The overcap is preferable embodied with a tamper-evident feature, e.g. a tamper-evident band, to evidence the first time removal of the overcap.

The overcap may be tethered to the base, e.g. to avoid loss of the overcap or to prevent that users improperly discard the overcap.

Preferably the overcap is provided with visual signs to indicate to the user that the cap should be rotated to remove it from the base, e.g. by thread formations being visible in the overcap and/or one or more indicative arrows on the overcap.

Preferably the overcap is at least partly transparent to allow the user to see the rotary part and/or upper sealing arrangement of the closure device.

The upper sealing arrangement can be embodied as desired for the dispensing of the product.

In a possible embodiment the upper sealing arrangement is a self-closing sealing arrangement, e.g. a duck-bill or slit valve as are known in the art.

In another embodiment the upper sealing arrangement comprises an underpressure actuated valve, that opens when an underpressure is established at an outlet of the closure device. An example is e.g. disclosed by Smartseal AS in WO2006028378.

In another embodiment the upper sealing arrangement comprises a push-pull bidon-type valve as is known in the art.

In another embodiment the upper sealing arrangement is embodied as a teat, e.g. when the closure device is secured to or to be secured to a package containing pre-prepared infant feed, e.g. formula milk.

In another embodiment the upper sealing arrangement comprises a flip-top cap.

In another embodiment the upper sealing arrangement comprises a screw cap.

The motion transfer means cause the rotational motion of the rotary part—which is entrained by the rotating overcap during the first time removal thereof from the base—to be transferred into a rupturing motion of the rupturing member relative to the base. For example the rupturing motion may be a telescopic motion or a helical motion of the rupturing member.

In a helical motion embodiment of the rupturing motion the closure device has rotation-to-helical motion transfer means which are adapted to entrain the rupturing member with the rotary motion of the rotary part and at the same time cause the rupturing member to move in an axial direction towards the lower seal so that the rupturing member engages on the lower seal and causes the rupturing thereof. For example such helical motion can be effected with the rupturing member and the base having cooperating threads, the rupturing member for example being coupled to the rotary part by one or more lugs engaging in one or more corresponding axial slots. Other arrangements that allow to entrain the rupturing member with the rotation of the rotary part whilst also causing or allowing axial motion of the rupturing member will be readily apparent for the skilled person, e.g. the one part having one or more axial members protruding into or through one or more corresponding openings in the other part.

In a telescopic motion embodiment the rupturing member is envisaged to perform a linear motion, e.g. at rights angles to the lower seal, e.g. similar to a punch device. In an embodiment thereof the closure device may comprise cooperating linear guide members on the body of the base on the one hand and on the lower seal rupturing member on the other hand. For example the base has one or more linear grooves, preferably at right angles to a foil type lower seal, and the rupturing member one or more bosses protruding into a groove to form a linear guide. Other linear guide arrangements are also possible. The rotary motion of the rotary part upon first time removal of the overcap is transferred to the linearly guided rupturing member by any suitable rotation-to-linear motion transfer means. This may e.g. include cooperating screw threads on the rotary part and the rupturing member, but may, e.g. in a variant comprise one or more inclined faces, e.g. the end of teeth, on the rotary part and one or more complementary inclined faces on the linearly guided rupturing member so that upon first time removal of the overcap the resulting rotation of the rotary part causes the rupturing member to be pressed towards the lower seal and cause its rupture.

The rupture caused by the operation of the rupturing member may be in the form of a closed contour incision through the lower seal, so that a central portion of the lower seal is fully released from surrounding portion of the lower seal. The cut may also be a partial cut, so that a central portion of the lower seal remains attached to a surrounding portion of the lower seal, as a flap.

The overcap and the rotary part may be provided with one or more meshing portions, e.g. one or more teeth on the one part meshing with one or more corresponding formations on the other part.

As an alternative for a meshing of one or more coupling members of the rotary part with one or more coupling members of the overcap one can also envisage other forms of coupling to establish that the rotary part is entrained with the overcap in it's unscrewing for the first time removal.

For example the overcap and rotary part may be provided mating, form-locking sections that are non-cylindrical, e.g. oval.

In another embodiment the overcap and rotary part may be connected by a temporary and breakable connection, e.g. obtained by one or more welding spots, by an adhesive, or by one or more breakable (plastic) connector members placed between the overcap and the rotary part or integrated with one or both of these components. This breakable connection then temporarily interconnects the two components, has sufficient strength to entrain the rotary part, and then is allowed to break if the overcap is completely removed.

In another example the two components are friction fitted onto each other, the friction being sufficient to cause the mentioned entraining of the rotary part with the overcap rotation, and the frictional coupling being ended if the overcap is completely removed. In another example provision is made for one or more resilient members formed on either the overcap or the rotary part, said resilient members being adapted to provide a temporary connection between these parts and releasing once the rotary part has been sufficiently rotated to cause the rupture of the lower seal. E.g. the rotary part has one or more resilient lips engaging on the overcap during the opening process.

Further examples and preferred features of the inventive closure device are mentioned in the subclaims and in the description with reference to the drawings.

The present invention also relates to a container, e.g. a collapsible pouch, provided with a closure device.

It is noted that the rupturable barrier may be mounted at the underside of the base when the closure device is pre-assembled. This e.g. allows to provide an aseptic closure device, wherein the internal passages for the product are hermetically sealed from the environment.

It is also possible that the rupturable seal is mounted between the container body and the base, e.g. between the neck of a container and the base. For example the rupturable seal is first mounted on the container, so as to extend across the container opening, and then the base of the closure device is mounted on the container body. This e.g. allows to fill containers with a product, e.g. a food product, such as a beverage, then seal the opening of the container with the rupturable seal, and then later apply the closure device with its base on the container. For example the step of filling the container and sealing the opening with the rupturable barrier are done under aseptic conditions, and the application of the closure with its base on the container under non-aseptic conditions.

The present invention will now be explained with reference to the drawings.

DETAILED DESCRIPTION OF EMBODIMENTS

Figure 1:
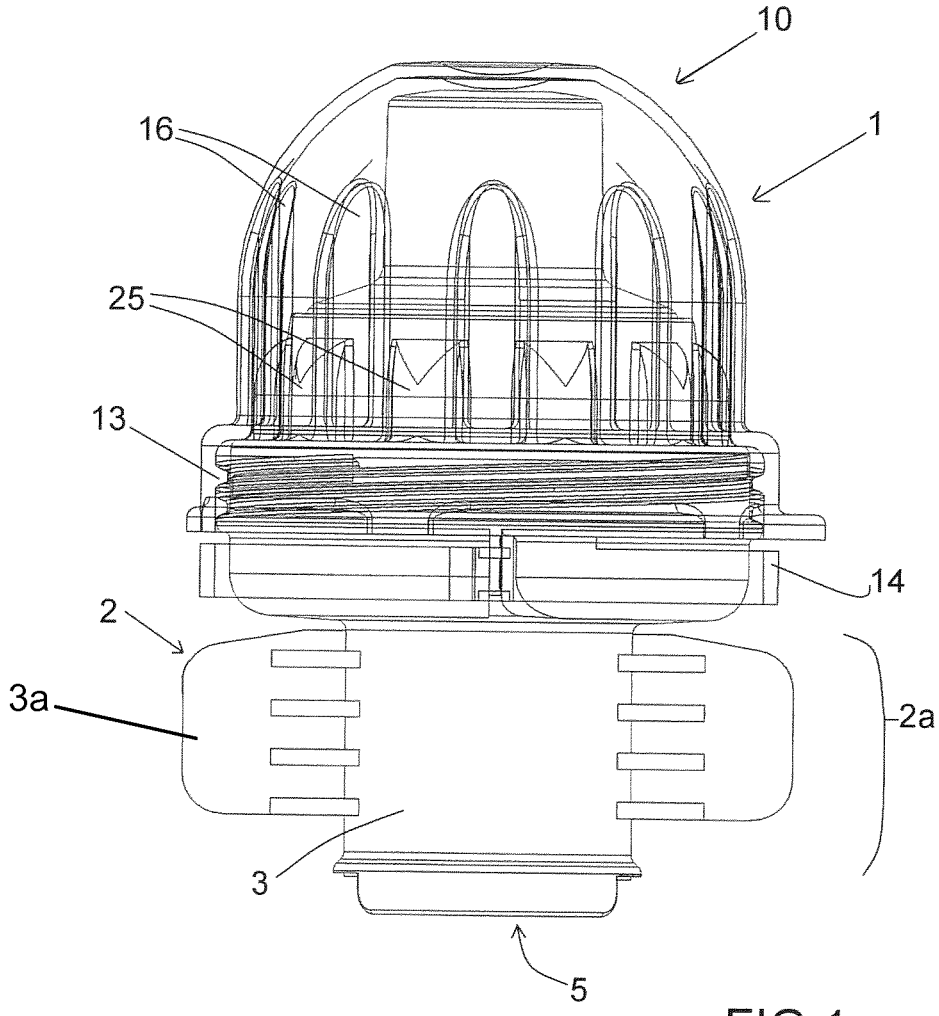
FIG. 1 shows in side view an example of a closure device according to the invention prior to mounting on a collapsible pouch.
Figure 2:
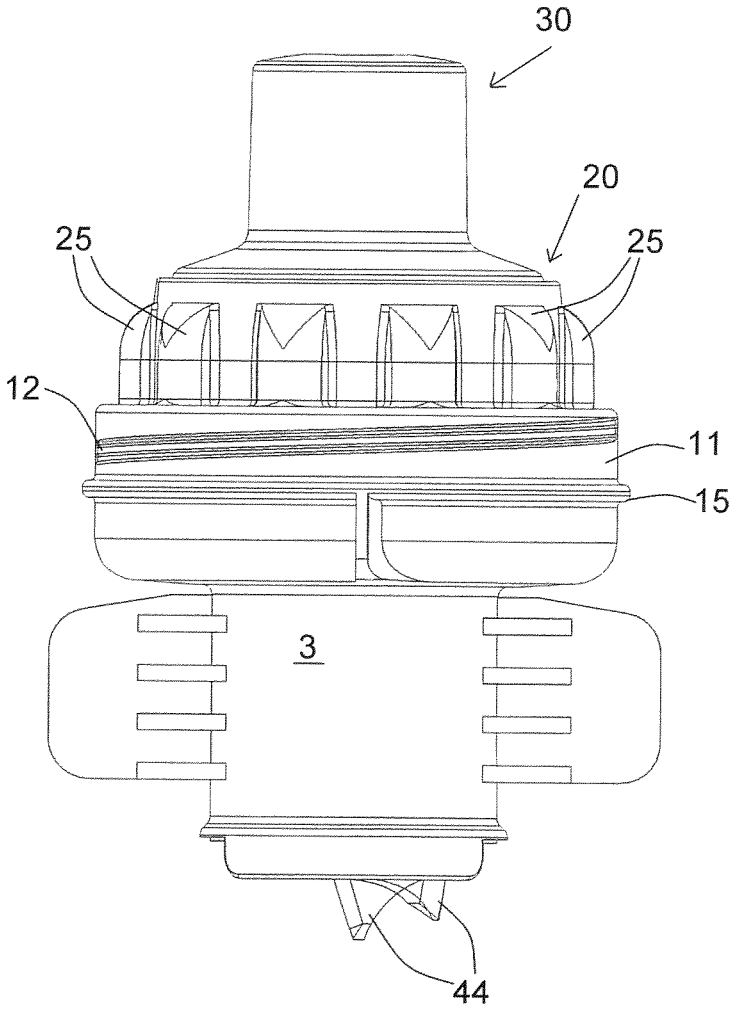
FIG. 2 shows the closure device of FIG. 1 after removal of the overcap.
Figure 3:
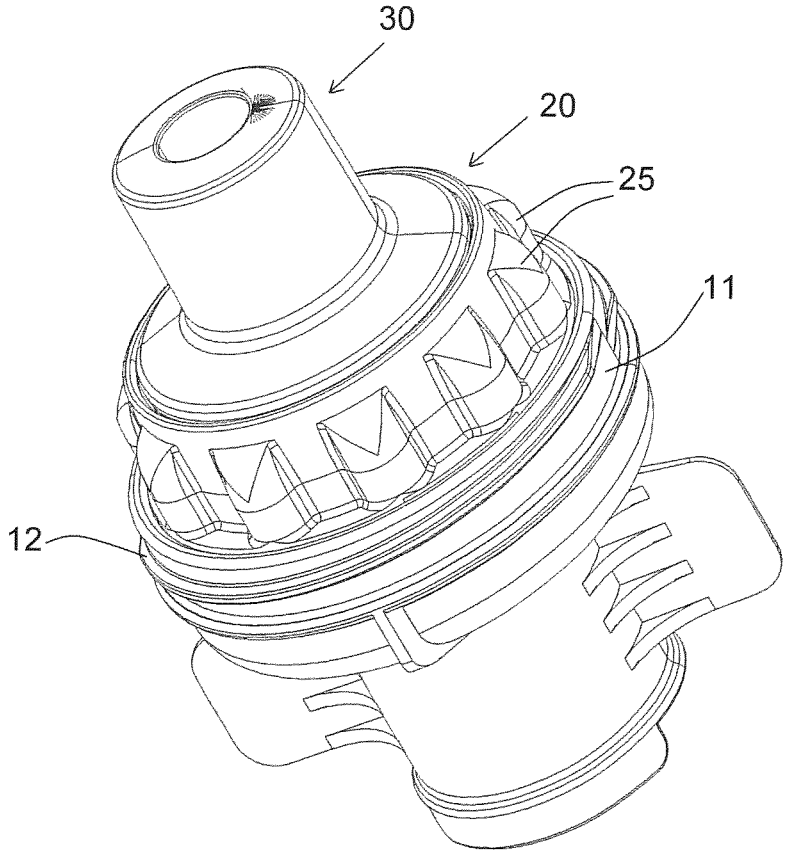
FIG. 3 shows the closure device of FIG. 2 in perspective view from above.
Figure 4:
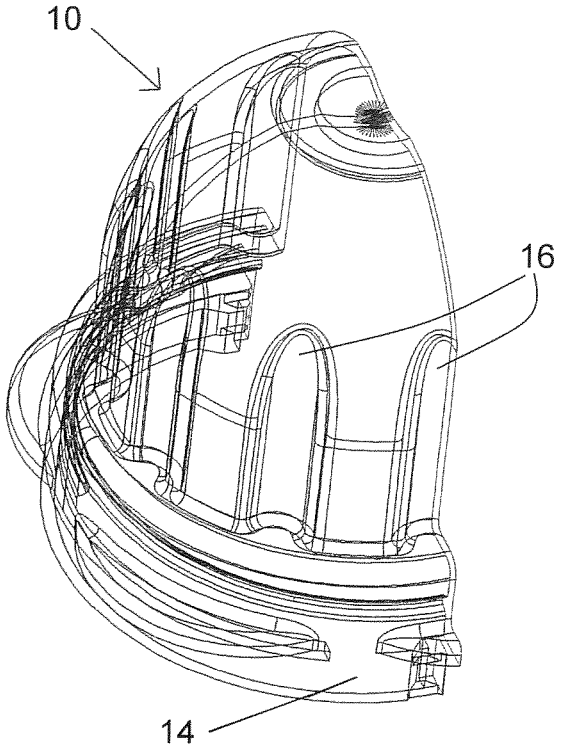
FIG. 4 shows a portion of the overcap after removal in perspective view from above, FIG. 5 the closure device of FIG. 2 in perspective view from below, FIG. 6*a* the rotary part of the closure device of FIG. 1 with the upper sealing arrangement in perspective view, FIG. 6*b* the central member of said rotary part in cross-section, FIG. 6*c* the central member and the upper sealing arrangement in cross-section, FIG. 6*d* the rotary part in cross-section, FIG. 7 the rotary part and the foil cutting member of the closure device in the condition of FIG. 1, FIG. 8 the base, rotary part and foil cutting member of the closure device in the condition of FIG. 1, FIG. 9 the rotary part and the foil cutting member of the closure device in the condition of FIG. 2, FIG. 10 the base, rotary part and foil cutting member of the closure device in the condition of FIG. 2, FIG. 11 the base and rotary part with upper sealing arrangement of the closure device, the foil cutting member being left out for clarity.
Figure 5:
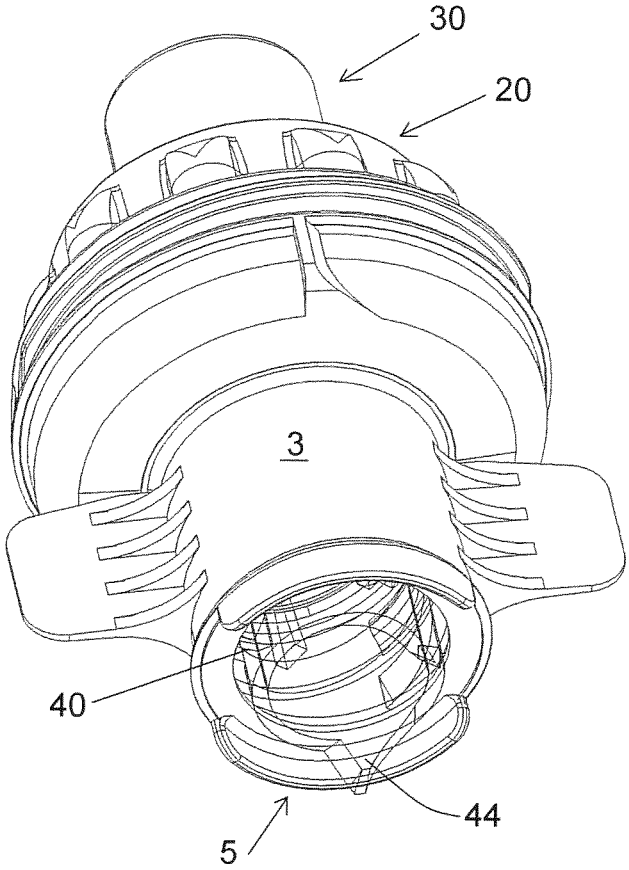

With reference to the FIGS. 1-11 a first example of a closure device and a container provided with such a closure device will be discussed. A second example will be discussed with reference to FIGS. 12-15.

In the first and second examples the closure device 1, 101 is designed to be heat- or induction sealed between the opposed film walls of a collapsible pouch (not shown). It will be appreciated that in alternative versions the closure device 1, 101 may be applied to all sorts of product containers, preferably said containers being filled with a flowable product, e.g. a liquid, pasty or powdery product.

The closure devices 1, 101 serve to keep the container sealed as long as no dispensing needs to take place. Once dispensing is desired, the closure device is operated by the user and the closure device serves as dispensing device to dispense the product from the container.

In general the closure devices 1, 101 here comprises a base 2, 102 having a body with a connector portion 2*a*, 102*a* adapted to mount the closure device on the product container. As is preferred the base is formed by injection moulding of suitable plastic material. Here, as an example, the connector portion 2*a*, 102*a* comprises a central tubular portion 3 with diametrically opposed wing structures 3*a*. In other exemplary designs the connector portion 2*a*, 102*a* may be embodied with a radial flange to attach the base to a wall of the container, e.g. to a film wall of a pouch or a panel of a carton, or embodied to be screwed onto a threaded neck of a container, etc. The skilled person is well aware of such embodiments of the connector portion 2*a*, 102*a*.

The base 2, 102 has a product channel 5, 105 therein, here extending through the tubular portion 3, 103 of the base.

A rupturable seal, here embodied as a foil 4, 104, occludes the product channel 5, 105 and forms a lower seal.

As is preferred the rupturable seal 4, 104, is formed at the lower end, effectively the entry opening, of the product channel 5, 105. No product enters the channel 5, 105 until the lower seal is ruptured.

The foil 4, 104 is preferably heat- or induction sealed to the base 2, 102. The foil 4, 104 may include one or multiple layers. The foil 4, 104 may include one or more metal layers, e.g. aluminium, to obtain enhanced barrier properties as is known in the art.

Instead of a foil another rupturable membrane may also be used, e.g. an injection moulded membrane, possibly injection moulded monolithic with the body of base 2, 102.

The rupturable seal may include one or more lines of weakness, this is not preferred.

The protective overcap 10, 110 is at first connected to the base 2, 102 and is adapted to be rotated by the user with respect to the base 2, 102 in order to remove the overcap from the base 2, 102.

Here the base 2, 102 comprises an annular wall portion 11, 111 having an exterior side 11*a*. The overcap 10, 110 and the exterior side 11*a* of the annular wall portion 11, 111 have cooperating threads 12, 13, 112 so that the overcap 10, 110 can be unscrewed from the base 2, 102 by the user. Preferably the unscrewing of the overcap 10, 110 requires less than a full turn of the overcap 10, 110 preferably about half a turn. As an alternative the overcap and base may e.g. have cooperating bayonet means.

As is preferred the overcap 10, 110 is provided with a tamper-evident feature, here a tamper-evident band 14, 114 at the lower edge of the cap skirt. In these examples, the band 14, 114 snaps under a retaining rib 15, 115 on the base body. One or more breakable bridges are present in the band 14, 114 and/or between the band and the cap so as to break when the overcap 10, 110 is unscrewed for the first time from the base 2, 102.

The closure device 1, 101 further comprises a rotary part 20, 120 that is rotatably journalled on the base. The rotary part has a product passage 21, 121 that is in open communication with the product channel 5, 105 in the base 2, 102.

An upper sealing arrangement 30, 130 is secured on the rotary part 20, 120 and forms an upper seal of the closure device 1, 101 that is remote from the lower seal 4, 104 and seals the product passage 21, 121 of the rotary part 20, 120 here at the upper end thereof as is preferred.

The upper sealing arrangement 30, 130 is in closed condition prior to first time removal of the overcap 10, 110.

In these examples the upper sealing arrangement 30, 130 is embodied a self-closing, underpressure actuated valve, that opens when an underpressure is established at an outlet of the valve. This valve is embodied according to the disclosure of WO2006028378.

As is preferred the upper sealing arrangement valve 30, 130 here comprises a valve element 31, 131 that is seated in a seat formed by the rotary part 20, 120 when said valve is closed. As is preferred the valve element 31, 131 is moved towards the container interior for opening of the valve, so that excess pressure in the container interior strives to close the valve 30, 130 once the foil 4, 104 has been ruptured.

As is preferred the underpressure actuated valve includes a vacuum chamber 32, 132 in communication with the outlet of the valve 30, 130, such that when underpressure is created at said outlet, notably by someone drinking from the container via the valve, the valve opens.

In this example the vacuum chamber 32, 132 is partly delimited by a flexible annular diaphragm 33, 133, that secured at its periphery to the rotary part 20, 120. Centrally in the diaphragm 33, 133 is a dispensing structure carrying the valve element 31, 131. Here the structure includes two concentric tubular portions 34*a*, 34*b*, interconnected at their upper ends, said structure sliding over a tubular portion 23 of the rotary part 20, 120. The inner portion 34*b* carries the valve element 31, 131 at its lower end. One or more ports are provided for product to enter into the inner tubular portion 34*b* when the valve 30, 130 is opened.

When someone sucks at the outlet of the valve 30, 130, the underpressure is also created in the chamber 32, 132 as this chamber is in communication with said inlet, e.g. via suitable holes and/or via a gap between the portion 23 and the dispensing structure of the valve 30, 130. The resulting pressure difference between the chamber 32, 132 and the atmospheric pressure acting on the outside of the diaphragm causes the valve to open.

It will be appreciated that the valve shown in the figures is just one example of an upper sealing arrangement, e.g. for use with a beverage container, e.g. a collapsible pouch beverage container, wherein it is envisaged that someone drinks by sucking on the valve 30.

Other possible embodiments for the upper sealing arrangement include a teat for use with babies and infants, e.g. for use with milk formula or another infant beverage or food product.

Other possible embodiments the upper sealing arrangement are for example a duck-bill valve, a slit valve, a flip-top or screw cap, etc.

The upper sealing arrangement may also be embodied to open or be opened when the rotary part is or is to be connected to an object, e.g. an applicator or (motorized) dispenser for the product to be dispensed from the container. e.g. for use in cosmetics (e.g. a brush), body care, laundry, or household products, e.g. detergent, cleaning agent, car wash, etc.

The closure device 1, 101 also comprises a lower seal rupturing member 40, 140, which is movable in a rupturing motion relative to the base 2, 102 to rupture the rupturable lower seal, here embodied as a foil cutter member 40, 140, to cut into the foil 4, 104. As is preferred the member 40, 140 is housed within the base 2, 102 and the rotary member 20, 120.

Motion transfer means are provided so as to effect the rupturing motion of the lower seal rupturing member 40, 140 upon rotary actuation of the rotary part 20, 120, which is in turn caused by the removal of the overcap 10, 110 from the base 2, 102 by the user.

The overcap 10, 110 engages on the rotary part 20, 120 so as to cause rotary motion of the rotary part 20, 120 upon removal by unscrewing of the overcap 10, 110.

In these examples the rotary part 20, 120 is provided with one or more outwardly protruding members or teeth 25, 125. The overcap 10 is provided with one or more inwardly protruding elements or teeth 16, or with a recess receiving a teeth 125, said elements meshing with each other so that the rotation of the cap 10, 110 is followed by the rotary part 20, 120. In the example of FIG. 1, as is preferred, the protrusions 16, 25 extend parallel to one another and at right angles to the rotation plane of the rotary part.

The coupling between the overcap 10, 110 and the rotary part 20, 120 causes the lower seal rupturing member 40, 140 to effect its rupturing motion to rupture the rupturable lower seal 4, 104 and thereby open the product channel. During this process of first time removal of the overcap 110 through rotation thereof the upper sealing arrangement 30, 130 remains in closed condition so that no spillage occurs even though the lower seal 4, 104 is now opened.

In the embodiment of FIGS. 1-11 the lower seal rupturing member 40 is connected to the rotary part 20 so as to be rotated with the rotary part 20 upon removal of the overcap 10 and so as to perform a helical rupturing motion, here from a starting position spaced above the seal towards said seal and then through the lower seal 4. In an alternative the rupturing motion could be a linear telescopic motion or other suitable path motion.

As is preferred the rotary part 20 has one or more inward lugs 27 extending into one or more axial slots 42 of the member 40, so that the member 40 follows the rotation of part 20 and at the same time is allowed to move axially towards the foil 4.

In the first example, as is preferred, the lower seal rupturing member 40 and the base 2 have cooperating threads 41, 3*b* to effect the axial component of the helical rupturing motion towards the lower seal 4. As is preferred the base has one or more threads 3*b* in the product passage 5, most preferably in the region of the tubular portion 3 when present.

As is preferred the lower seal rupturing member 40, 140 has a tubular body with a central bore therein, said body being located partly in the product channel 5, 105 in the base 2, 102 and partly in the product passage in the rotary part 20, 121. The product flows through the lower seal rupturing member 40, 140 upon dispensing of the product.

As is preferred the rotary part 20, 120 is snap fitted onto the base 2, 102. The wall 11, 111, has a snap edge at its upper end of the interior side and the rotary part 20, 120 having a mating snap edge 28.

As is preferred the rotary part 20, 120 is snap fitted onto the base 3, 103. The wall 11, 111, has a snap edge at its upper end of the interior side and the rotary part 20, 120 having a mating snap edge 28.

As is preferred the rotary part 20 here comprises a tubular portion of outer part 20*b* that extends into a bore of the base, here formed by an annular wall portion 17, that forms a part of the product passage 5. An annular product seal is present between said tubular portion of outer part 20*b* and the base 2 to prevent undesired leakage of product.

As is preferred the foil cutter member 40, 140 may have one or more cutting teeth 44, 144 to enhance the cutting effect, most preferably in combination with a helical rupturing motion.

A container filled with product and provided with a closure device 1, 101 is initiated for use by the user through unscrewing of the overcap 10, 110 from the base 2, 102. This may be indicated via one or more arrows on the overcap 10, 110 or via the visibility of the threads on the overcap 10 or other features of the cap. The user will grip the overcap 10, 110 and unscrew the cap 10, 110. By doing so, as explained in detail, the user now simultaneously causes the foil 4; 104 (likely to be invisible for the user) to be ruptured under the effect of member 40, 140 that is moved with its one or more teeth into and through the foil 4, 104. The user will presumably not even notice this rupturing at all. Once the cap 10, 110 has been removed, the user will —in this example —be able to drink from the container by sucking on the valve 30, 130. As explained the valve 30, 130 remains closed during the removal of the cap 10, 110, so that the user is not surprised by a rush of product from the container so that spillage is prevented or counteracted.

As explained the valve 30, 130 is an example for the upper sealing arrangement. Other types of upper sealing arrangements are possible as well. It will be appreciated that the rotary part 20, 120 will need little modification to carry another upper sealing arrangement.

Figure 6A:
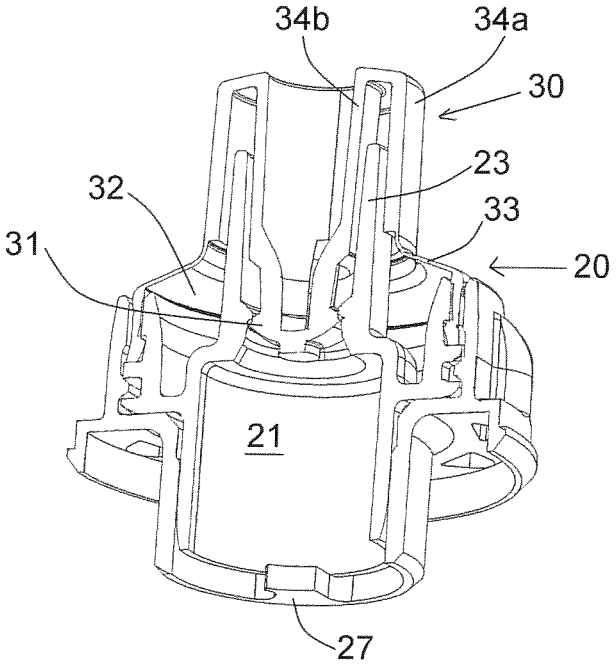
Figure 6B:
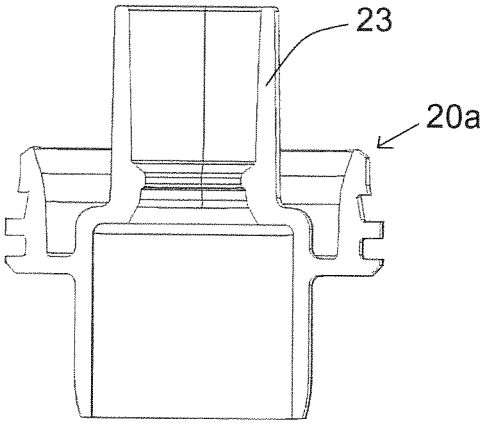
Figure 6C:
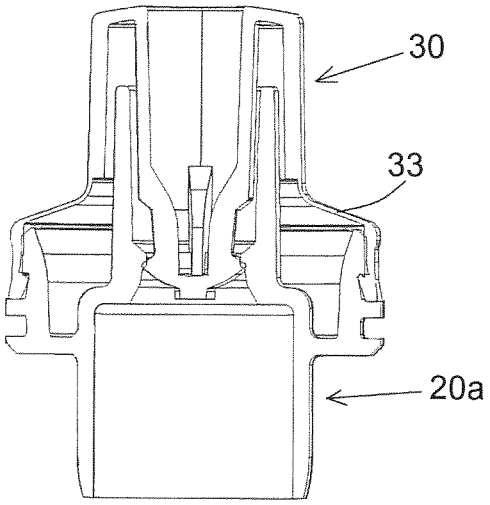
Figure 6D:
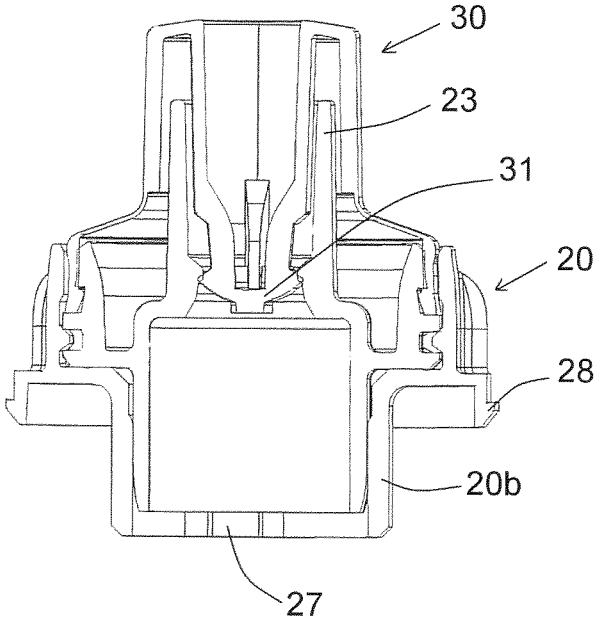
Figure 7:
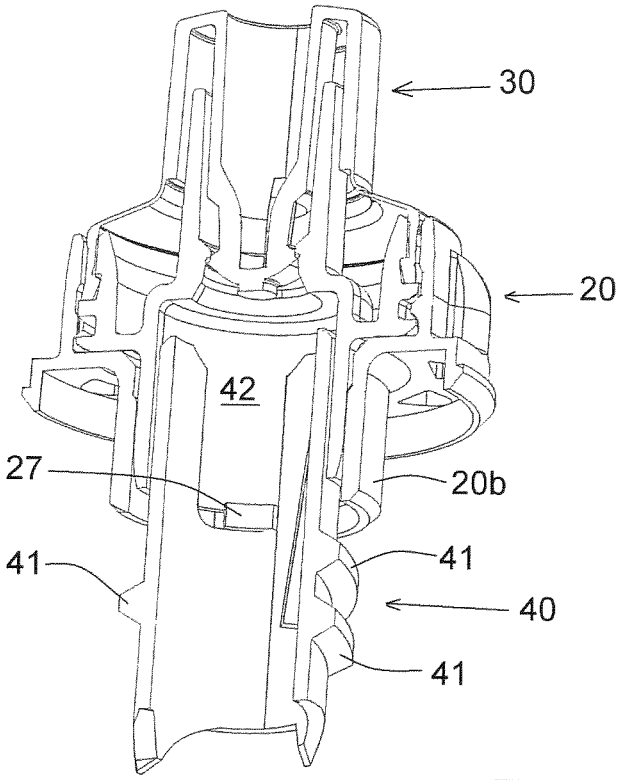
Figure 8:
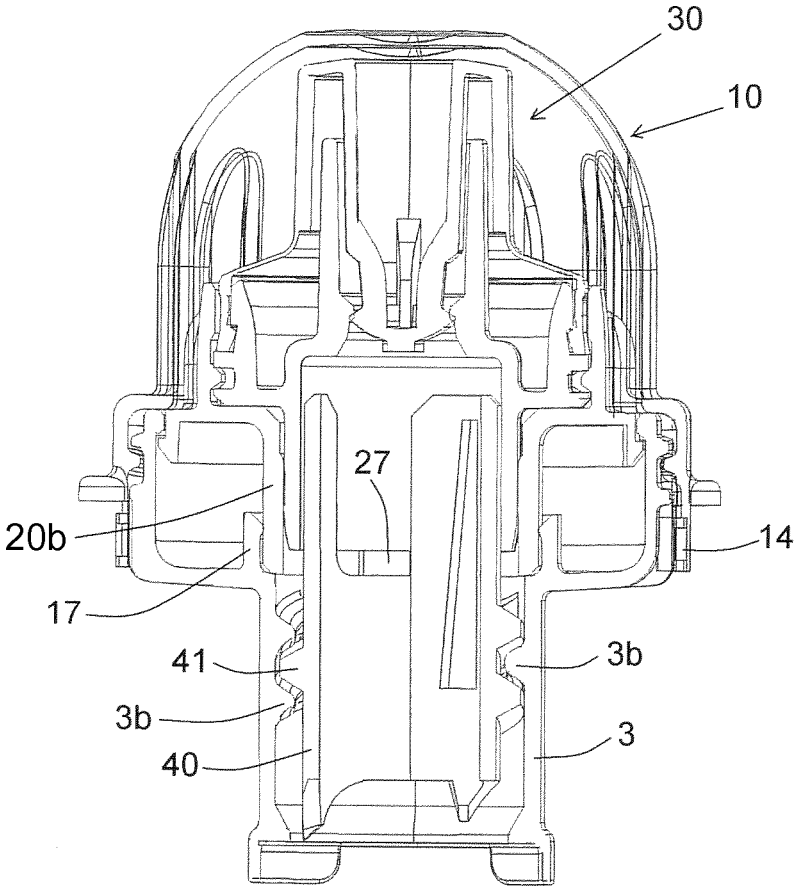
Figure 9:
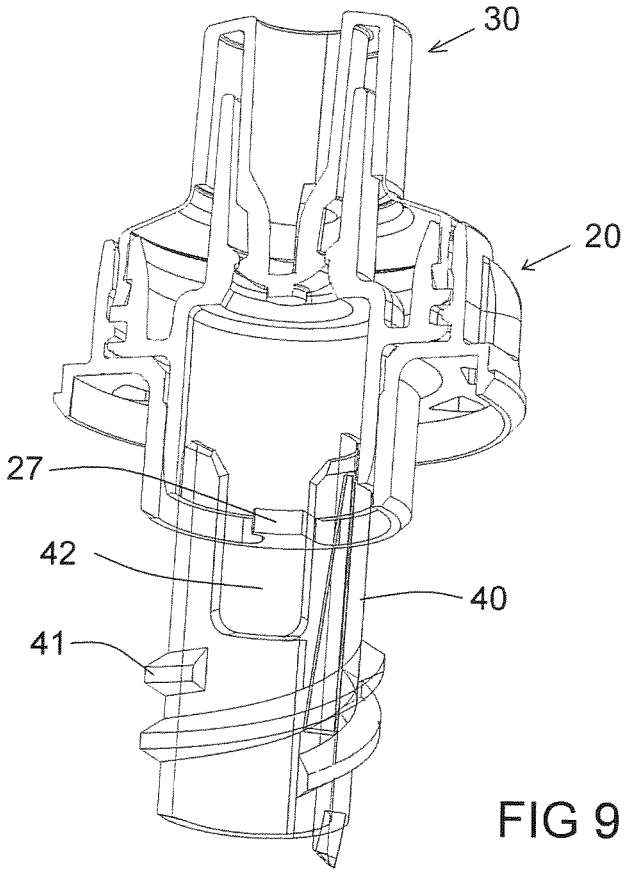
Figure 10:
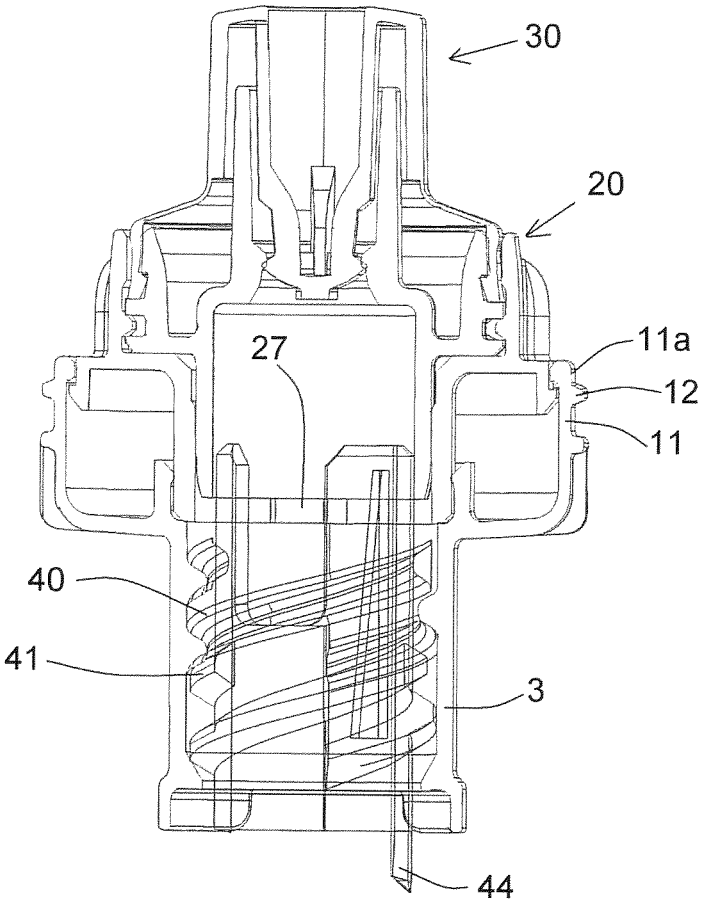
Figure 11:
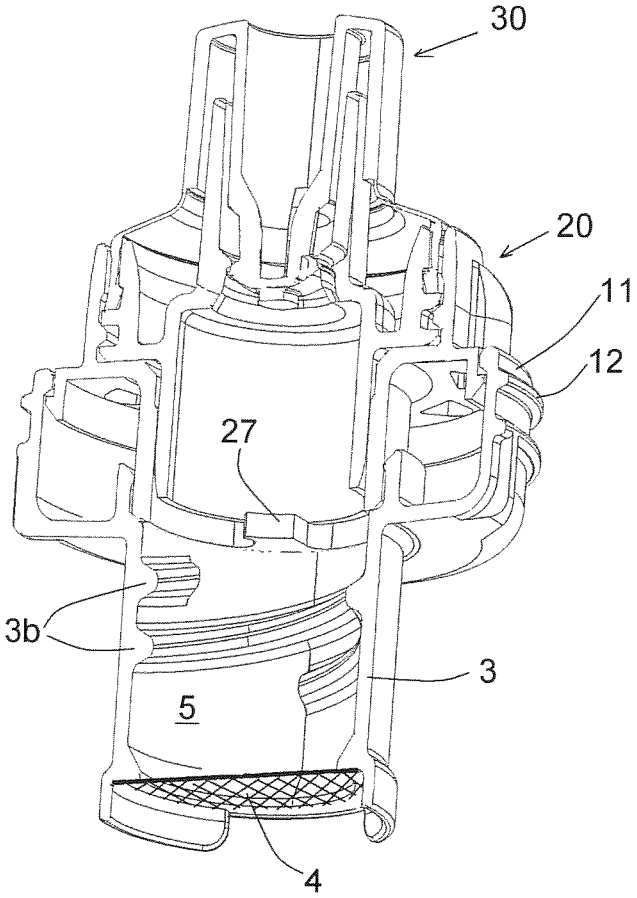
Figure 12:
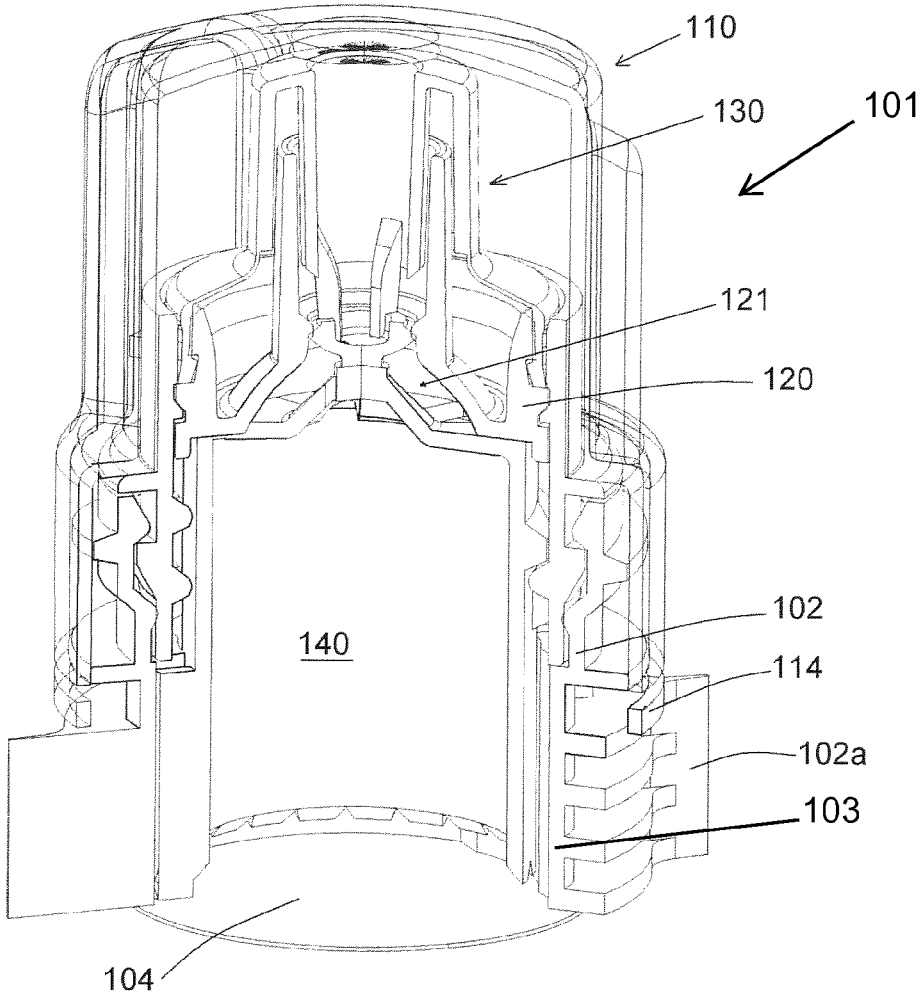
FIG. 12 shows in partly cut away side view a second example of a closure device according to the invention prior to mounting on a collapsible pouch.
Figure 13:
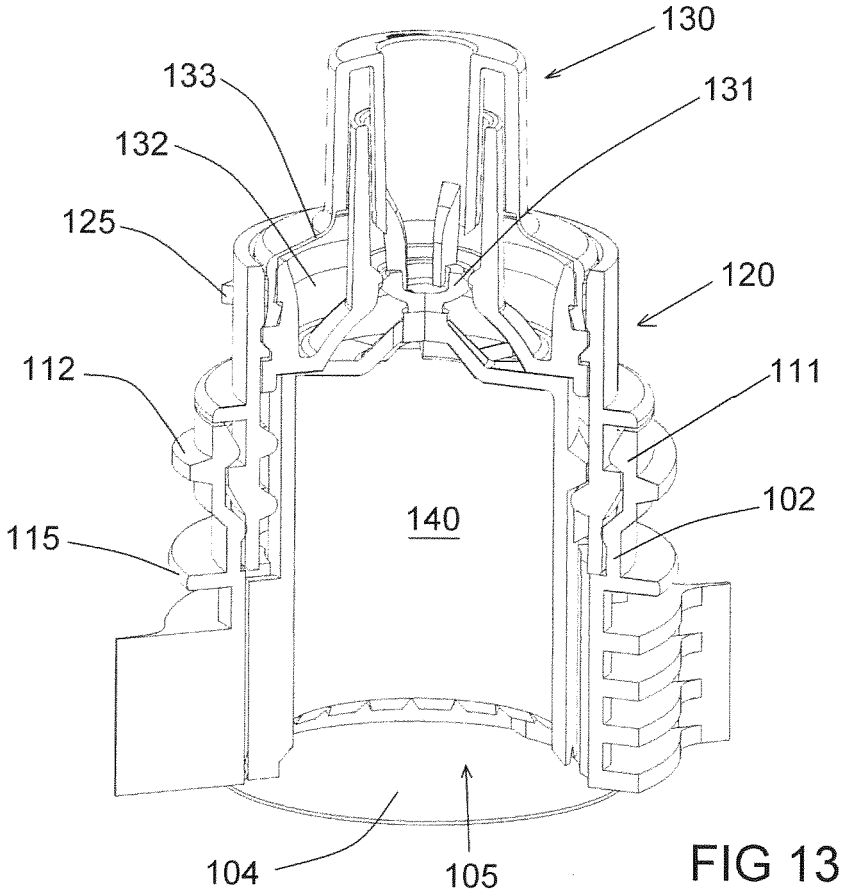
FIG. 13 shows the closure device in the condition of FIG. 12 with the overcap being left out for clarity.
Figure 14:
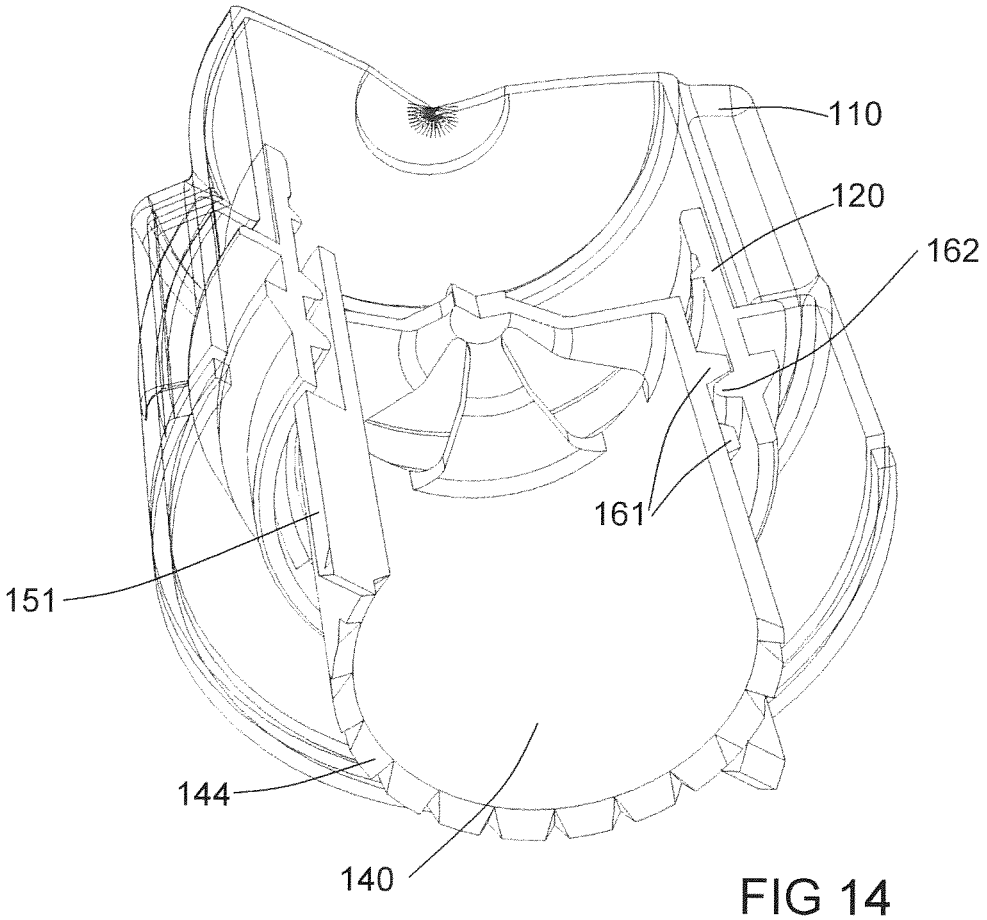
FIG. 14 shows the overcap, portion of the rotary part, and the rupturing member in the condition of FIG. 12.
Figure 15:
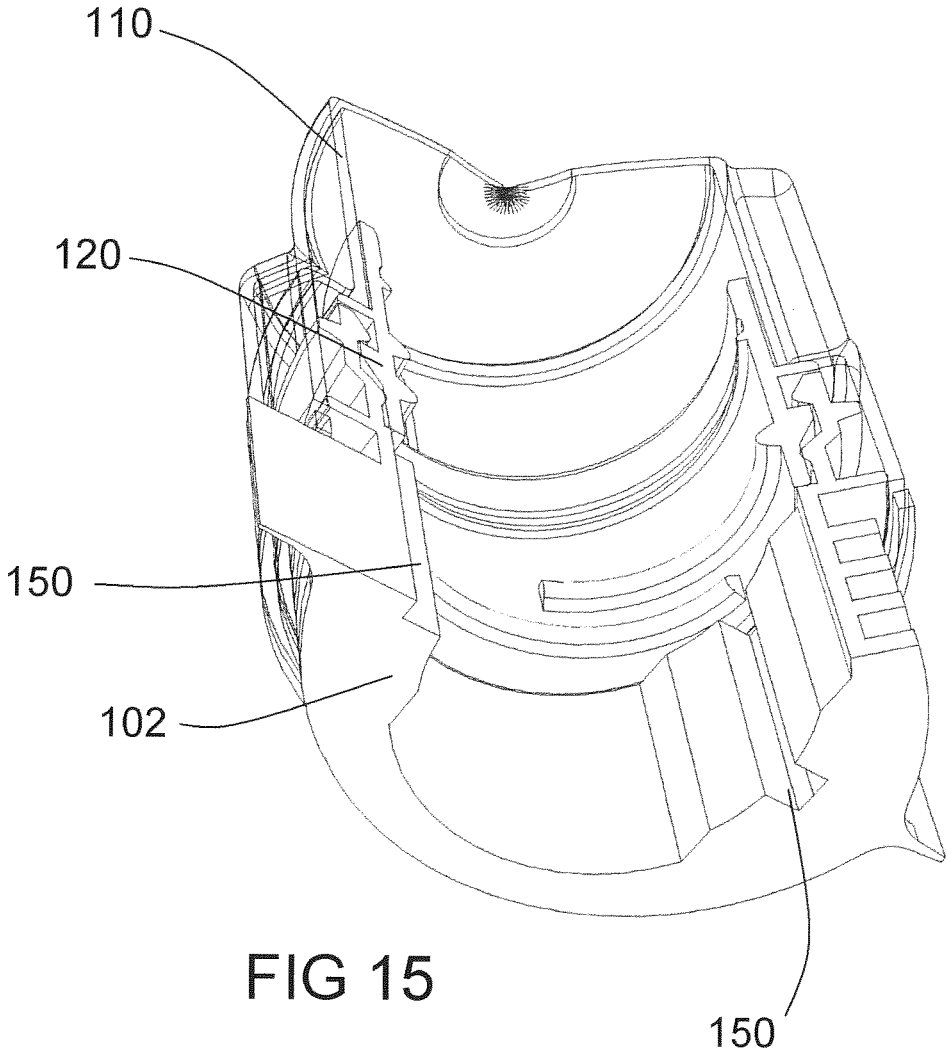
FIG. 15 shows the overcap, portion of the rotary part, and the base in the condition of FIG. 12.

In the first example the rotary part comprises a central part 20*a* as shown in FIG. 6*b* with the tubular portion 23 at the upper end thereof. It further includes a circumferential wall part coaxial with the tubular portion on which the diaphragm 33 is fitted. An outer part 20*b* of the rotary part 20 is fitted over the central part 20*a* so as to clamp the diaphragm 33 between said parts 20*a*, 20*b*. Here the outer part 20*b* carries the lug 27.

As is preferred the overcap 10, 110 is at least partly transparent, allowing the user to see inside, e.g. to establish that no contamination has occurred or to view the type of sealing arrangement.

With reference to FIGS. 12-15 now specific details of a second example of a closure device 101 according to the invention will be discussed.

In this second exemplary embodiment the rupturing member 140 is linearly guided with respect to the base 102.

The base 102 here has two linear grooves 150 (best seen in FIG. 15), here as is preferred axially and at right angles to a foil type lower seal 104. The rupturing member 140 has corresponding bosses, ribs or other members 151 (best seen in FIG. 14), each protruding into a groove 150 to form a linear guide assembly. It will be appreciated that other linear guide arrangements are also possible, e.g. the bore in the base and the rupturing member having a corresponding non-circular horizontal cross-section.

So in this second example the rupturing motion resembles that of a punch, wherein the teeth 144 establish a cut in the seal 104 which may e.g. be a full circle or part thereof.

The rotary motion of the rotary part 120 upon first time removal of the overcap 110 may transferred to the linearly guided rupturing member 140 by any suitable rotation-to-linear transfer mechanism.

In this example there are cooperating screw threads 161, 162 on the rupturing member 140 and the rotary part 120 respectively, so that when the part 120 is rotated upon removal of the overcap 110, the member 140 moves down towards the seal 104.

One may envisage an embodiment wherein the screw threads 161, 162 finally disengage from one another in the overcap removal process.

Instead of meshing screw threads 161, 162 the motion transfer mechanism may also comprise one or more inclined faces, e.g. formed by the ends of a series of teeth in circular arrangement, on the rotary part and one or more complementary inclined faces on the linearly guided rupturing member, e.g. at the top end thereof, so that upon first time removal of the overcap the resulting rotation of the rotary part causes the rupturing member to be pressed towards the lower seal and cause its rupture.

The invention claimed is:

1. A closure device for a dispensing a product from a product container, said closure device comprising:

a base having a body with a connector portion adapted to mount the closure device on a product container, said base comprising:

a product channel in the body of base, and a rupturable seal occluding the product channel and forming a lower seal of the closure device, a rotary part, that is rotatably journalled on the base, wherein the rotary part has a product passage in communication with the product channel in the base, an upper sealing arrangement arranged on the rotary part and forming an upper seal of the closure device that is remote from the lower seal and seals the product passage of the rotary part, a lower seal rupturing member that is movable in a rupturing motion relative to the base to rupture the rupturable lower seal, motion transfer means adapted so as to effect the rupturing motion of the lower seal rupturing member upon suitable rotary actuation of the rotary part, and a protective overcap that is removable by the user, wherein the upper sealing arrangement is in closed condition prior to first time removal of the overcap, wherein the overcap is connected to the base and is adapted to be rotated by the user with respect to the base in order to remove the overcap from the base, wherein the overcap engages the rotary part so as to cause rotary motion of the rotary part upon removal of the overcap, so that the lower seal rupturing member effects the rupturing motion to rupture the rupturable lower seal and thereby open the product channel by user removal of said overcap, and wherein the upper sealing arrangement is adapted to remain in closed condition, during the process of removal of the overcap.

2. The closure device according to claim 1, wherein the upper sealing arrangement is a self-closing sealing arrangement.

3. The closure device according to claim 1, wherein the upper sealing arrangement comprises an underpressure actuated valve that opens when an underpressure is established at an outlet of the valve.

4. The closure device according to claim 1, wherein the overcap has a tamper evident feature to evidence first time removal of the overcap from the base.

5. The closure device according to claim 1, wherein the lower seal rupturing member has a tubular body, said body being located partly in the product channel in the base and partly in the product passage in the rotary part, such that the product flows through the lower seal rupturing member upon dispensing.

6. The closure device according to claim 1, wherein the lower rupturable seal is a foil secured at its periphery to the body of the base.

7. The closure device according to claim 1, wherein the body of the base comprises an annular wall portion having an exterior side, the overcap and the exterior side of the annular wall portion having cooperating threads or bayonet means.

8. The closure device according to claim 7, wherein said annular wall portion has an interior side in which the rotary part is journalled.

9. The closure device according to claim 1, wherein the rotary part comprises a tubular portion extending into a bore of the base that forms the product passage, and wherein an annular seal is present between said tubular portion and the base.

10. The closure device according to claim 1, wherein the connector portion is adapted to secure the base to one or more film walls of a collapsible pouch.

11. The closure device according to claim 1, wherein the overcap is at least partly transparent to allow the user to see the rotary part and/or upper sealing arrangement of the closure device.

12. The closure device according to claim 1, wherein the overcap is embodied to delimit a hermetically sealed space prior to removal by the user, thereby shielding the upper sealing arrangement from the environment.

13. The closure device according to claim 1, wherein the motion transfer means comprises rotation-to-helical motion transfer means that is adapted to entrain the lower seal rupturing member with the rotary motion of the rotary part, and at the same time cause the lower seal rupturing member to move in an axial direction towards the rupturable lower seal so that the lower seal rupturing member engages the rupturable lower seal causing the rupturing thereof.

14. The closure device according to claim 1 further comprising cooperating linear guide members on the body of the base and on the lower seal rupturing member, wherein the motion transfer means comprises rotation-to-linear motion transfer means, and wherein the rotary motion of the rotary part upon first time removal of the overcap is transferred to the lower seal rupturing member by the rotation-to-linear motion transfer means.

15. The closure device according to claim 1, wherein the rotary part is provided with one or more outwardly protruding members, wherein the overcap is provided with one or more inwardly protruding elements, and wherein the outwardly protruding members and inwardly protruding elements mesh with each other so that the rotation of the overcap is followed by the rotary part.

16. The closure device according to claim 1, wherein the motion transfer means is adapted so as to affect the rupturing motion of the lower seal rupturing member upon suitable rotary actuation of the rotary part caused by removal of the overcap.

17. A product container provided with a closure device, said closure device comprising a base having a body with a connector portion mounted on the product container, said base comprising a product channel in the body of base, wherein a rupturable seal occludes the product channel and forms a lower seal, wherein the closure device comprises a rotary part that is rotatably journalled on the base, wherein the rotary part has a product passage in communication with the product channel, wherein the closure device comprises an upper sealing arrangement arranged on the rotary part and forming an upper seal that is remote from the lower seal and seals the product passage of the rotary part, wherein the closure device comprises a lower seal rupturing member, which is movable in a rupturing motion relative to the base to rupture the rupturable lower seal, wherein the closure device comprises a motion transfer means adapted so as to effect the rupturing motion of the lower seal rupturing member upon suitable rotary actuation of the rotary part, wherein a protective overcap is provided that is removable by the user, wherein the upper sealing arrangement is in closed condition prior to first time removal of the overcap, wherein the overcap is connected to the base and is adapted to be rotated by the user with respect to the base in order to remove the overcap from the base, wherein the overcap engages on the rotary part so as to cause rotary motion of the rotary part upon removal of the overcap, so that the lower seal rupturing member effects the rupturing motion to rupture the rupturable lower seal and thereby open the product channel by user removal of said overcap, and wherein the upper sealing arrangement is adapted to remain in closed condition during the process of removal of the overcap.

18. Method for dispensing a product from a product container having a closure device according to claim 17, wherein the overcap is removed by the user for the first time thereby rupturing the lower rupturable seal of the closure device.

19. The product container according to claim 17, wherein the product container is embodied as a collapsible pouch.

* * * * *